US007221345B2

(12) United States Patent
Lee et al.

(10) Patent No.: US 7,221,345 B2
(45) Date of Patent: May 22, 2007

(54) LIQUID CRYSTAL DISPLAY AND APPARATUS OF DRIVING LIGHT SOURCE THEREFOR

(75) Inventors: Inn-Sung Lee, Suwon (KR); Moon-Shik Kang, Seongnam (KR); Song-Yi Han, Yongin (KR)

(73) Assignee: Samsung Electronics Co., Ltd. (KR)

( * ) Notice: Subject to any disclaimer, the term of this patent is extended or adjusted under 35 U.S.C. 154(b) by 210 days.

(21) Appl. No.: 10/626,758

(22) Filed: Jul. 21, 2003

(65) Prior Publication Data

US 2004/0056830 A1 Mar. 25, 2004

(30) Foreign Application Priority Data

Jul. 22, 2002 (KR) ..... 10-2002-0042935

(51) Int. Cl.
*G09G 3/36* (2006.01)

(52) U.S. Cl. ..... 345/87; 315/169.4; 345/102

(58) Field of Classification Search ..... 345/87, 345/70, 102; 323/355–359
See application file for complete search history.

(56) References Cited

U.S. PATENT DOCUMENTS 6,661,181 B2 * 12/2003 Shin ..... 315/169.4
6,812,921 B2 * 11/2004 Hsu ..... 345/211
7,145,546 B2 * 12/2006 Kang et al. ..... 345/102
2001/0011980 A1 * 8/2001 Jang ..... 345/87
2002/0154080 A1 * 10/2002 Miyazaki ..... 345/87

FOREIGN PATENT DOCUMENTS

CN 2453468 Y 10/2001

* cited by examiner

*Primary Examiner*—Sumati Lefkowitz
*Assistant Examiner*—Tammy Pham
(74) *Attorney, Agent, or Firm*—Cantor Colburn LLP

(57) ABSTRACT

An apparatus of a light source for a liquid crystal display includes two transformers connected between a driver and respective lamps, and a driving signal from a driver is supplied to the lamps through the transformers. Secondary sides of the transformers are connected to each other, and a node between the transformers works as a neutral point in that loads connected to the transformers are symmetrical. The neutral point moves when the symmetry of the load distribution is broken under abnormal operation such as arc generation due to disconnection of the transformers. The movement of the neutral point increases the voltage at the node between the transformers and the driver is shut down when a voltage divided from the voltage of the node is larger than a reference voltage.

12 Claims, 5 Drawing Sheets

LIQUID CRYSTAL DISPLAY AND APPARATUS OF DRIVING LIGHT SOURCE THEREFOR

BACKGROUND OF THE INVENTION (a) Field of the Invention

The present invention relates to a backlight driving apparatus of a liquid crystal display, and more in particular to a circuit capable of preventing an arc of an inverter of the backlight.

(b) Description of the Related Art

Display devices used for monitors of computers and television sets include self-emitting displays such as light emitting diodes (LEDs), electroluminescences (ELs), vacuum fluorescent displays (VFDs), field emission displays (FEDs) and plasma panel displays (PDPs) and non-emitting displays such liquid crystal displays (LCDs) requiring light source.

An LCD includes two panels provided with field-generating electrodes and a liquid crystal (LC) layer with dielectric anisotropy interposed therebetween. The field-generating electrodes supplied with electric voltages generate electric field in the liquid crystal layer, and the transmittance of light passing through the panels varies depending on the strength of the applied field, which can be controlled by the applied voltages. Accordingly, desired images are obtained by adjusting the applied voltages.

The light may be emitted from a light source equipped in the LCD or may be natural light. When using the equipped light source, the total brightness of the LCD screen is usually adjusted by regulating the ratio of on and off times of the light source or regulating the current through the light source.

A light device for an LCD, i.e., a backlight unit usually includes a light source and an inverter for driving the light source. The light source includes a plurality of fluorescent lamps and the inverter converts a DC (direct current) input voltage from an external device into an AC (alternating current) voltage, and then applies the voltage to turn on the lamps.

For obtaining good image quality, the current flowing in the lamps is required to be uniform such that the luminescence of the lamps uniform. In order to obtain uniform current, a current detector for detecting the current in the lamps is provided and the current is feedback-controlled depending on the detected current.

A conventional technique senses a feedback current and shuts down an inverter when there is no detected current due to change of loads such as disconnection of lamps or separation of an output connector, etc. However, there are some cases that the feedback current is detected even though abnormal operation occurs. For example, the disconnection in a transformer, loose connection of the output connector and so on may generate arcs, which in turn generate the feedback current. Since the inverter is not shut down in this condition, the arc generation continues to burn the transformer or the output connector.

SUMMARY OF THE INVENTION

A motivation of the present invention is to provide a lighting unit capable of shutting down an inverter when arcs are generated.

To accomplish the motivation, an embodiment of the present invention performs shut-down operation after sensing a voltage of a neutral point of two transformers.

An apparatus of driving a liquid crystal display according to an embodiment of the present invention includes first and second lamp units and first and second transformers connected thereto. Each of the first and the second transformers includes a primary side and a secondary side. The secondary side of the first transformer has a first terminal connected to the first lamp unit and a second terminal, and the secondary side of the second transformer includes a first terminal connected to the second terminal of the secondary side of the first transformer and a second terminal connected to the second lamp unit. The apparatus further includes a driver converting a DC signal into an AC signal and supplying the AC signal to the primary sides of the first and the second transformer, and a voltage sensor for sensing a voltage at a middle point between the second terminal of the secondary side of the first transformer and the first terminal of the secondary side of the second transformer.

The driver is preferably shut down when the voltage sensed by the voltage sensor is larger than a reference voltage.

The apparatus may further include a voltage divider for dividing the voltage at the middle point and providing the divided voltage for the voltage sensor. The voltage divider preferably includes first and second resistors serially connected to the middle point.

Preferably, the apparatus further includes an on/off controller supplying an off signal to the driver in response to the voltage sensed by the voltage sensor, and/or a feedback controller detecting a current flowing through the first and the second lamp units and controlling the on/off controller based on the detected current.

Each of the first and the second lamp units may include a single lamp, or a plurality of lamps connected in series. The primary sides of the first and the second transformers are preferably connected in parallel to the driver.

It is preferable that the apparatus further includes first and second resistors connected to the first and the second lamp units, respectively, and the first and the second resistors are commonly connected to a ground.

According to an embodiment of the present invention, a liquid crystal display is provided, which includes a lighting unit and a liquid crystal panel assembly. The lighting unit includes first and second lamps, first and second transformers respectively connected to the first and the second lamps, including primary sides and secondary sides, and transmitting an AC signal for driving the first and the second lamps, and a driver supplying a signal to the primary sides of the first and the second transformers. A liquid crystal panel assembly includes liquid crystal for displaying images by adjusting transmittance of light generated from the lighting unit. The secondary sides of the first and the second transformers are connected to each other to form a neutral point, and the driver is shut down when a voltage divided from the voltage at the neutral point is larger than a reference voltage.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF PREFERRED EMBODIMENTS

The present invention now will be described more fully hereinafter with reference to the accompanying drawings, in which preferred embodiments of the inventions invention are shown. This invention may, however, be embodied in many different forms and should not be construed as limited to the embodiments set forth herein.

Now, LCDs and methods of driving light source therefor according to the present invention will be described in detail with reference to accompanying drawings.

An LCD according to an embodiment of the present invention will be described with reference to FIGS. 1–3.

Figure 1:
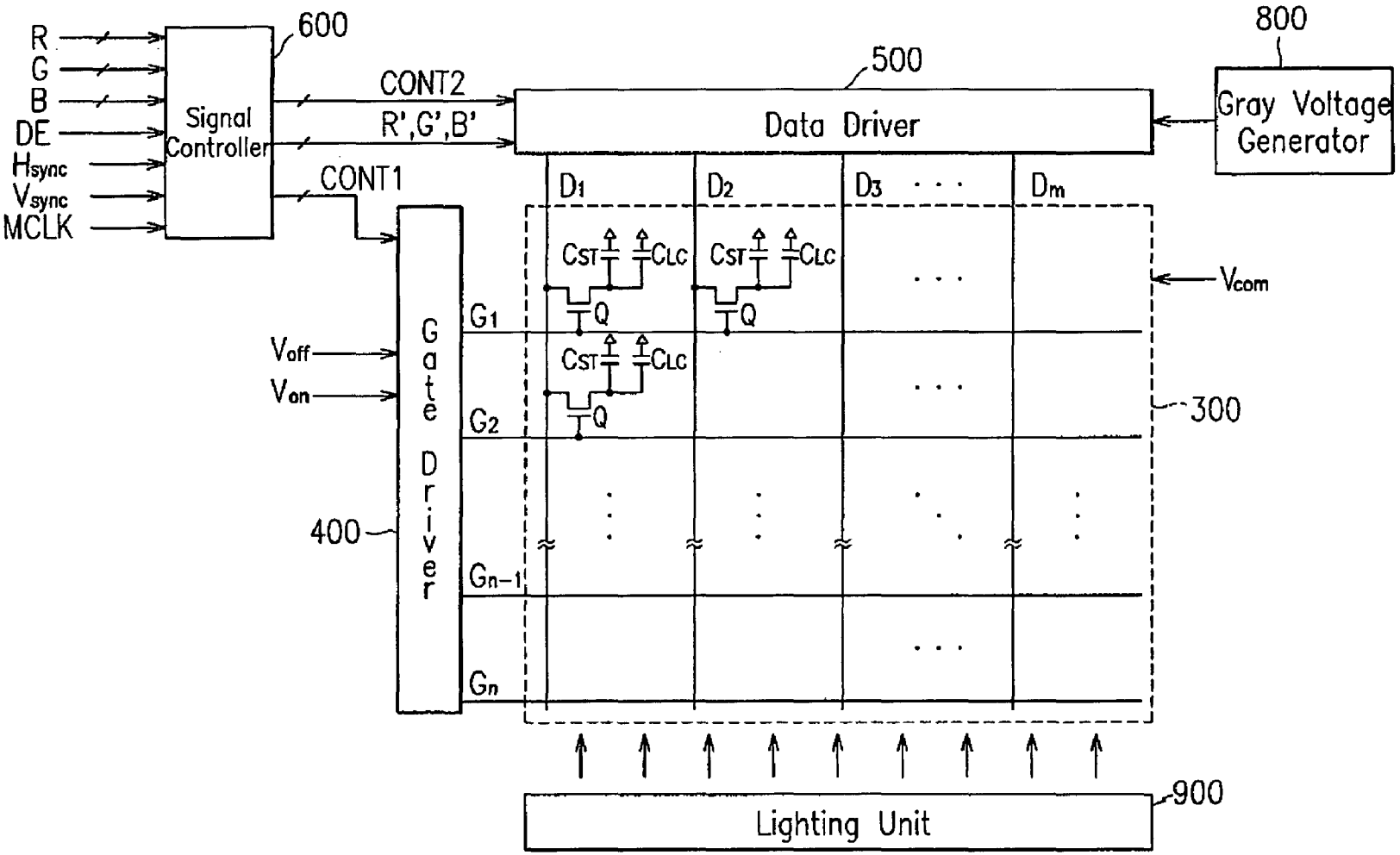
FIG. 1 is a block diagram of an LCD according to an embodiment of the present invention.
Figure 2:
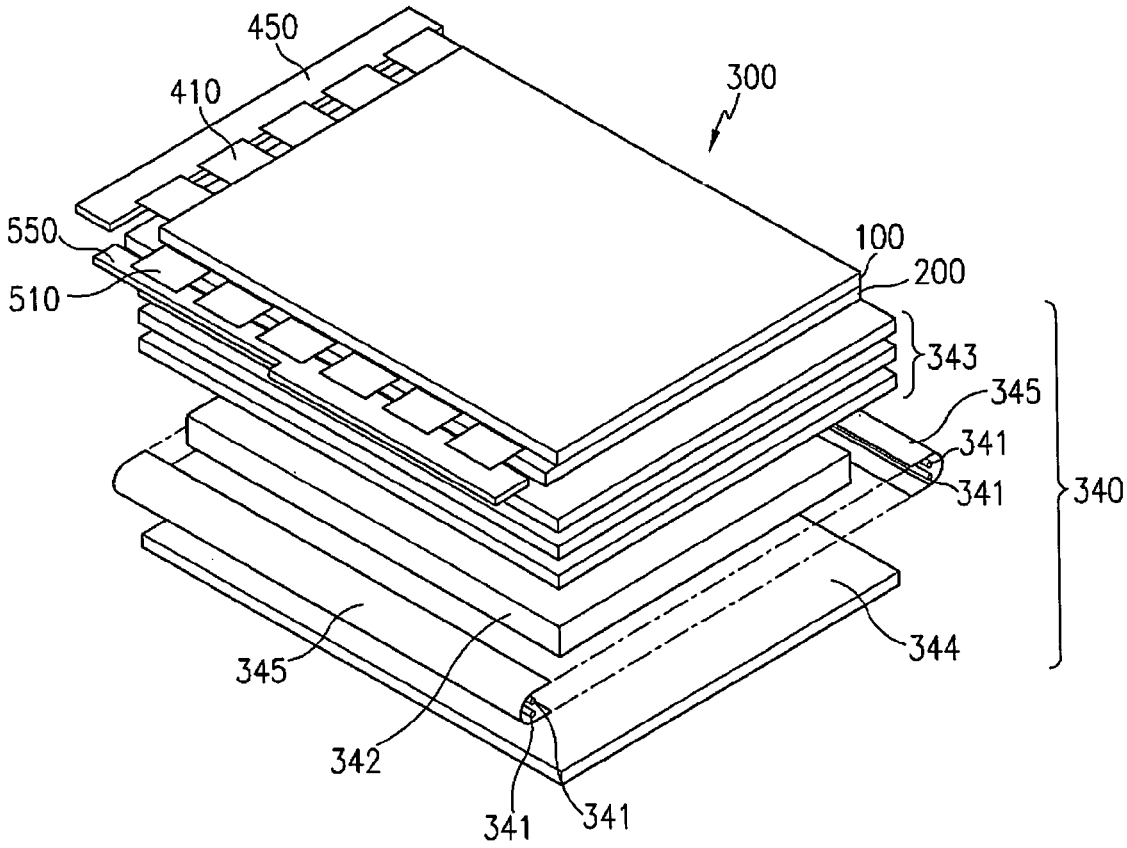
FIG. 2 is an exploded perspective view of an LCD according to an embodiment of the present invention.
Figure 3:
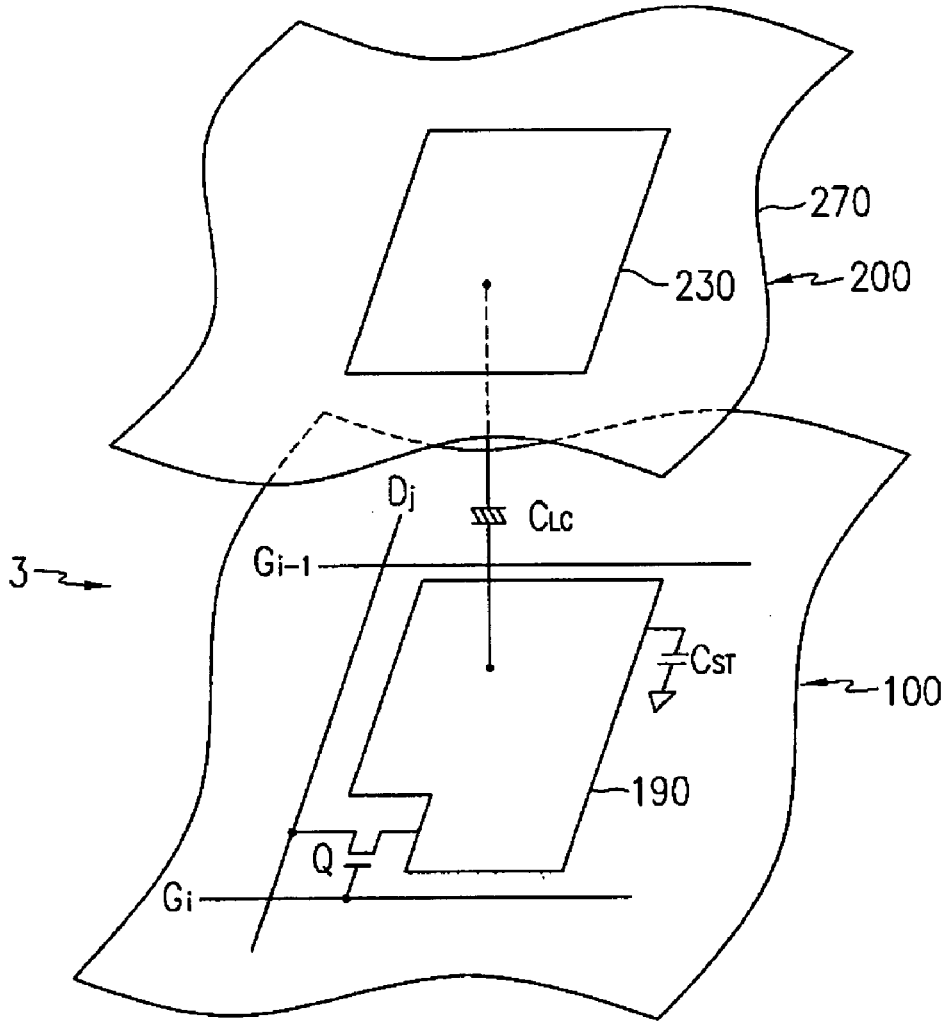
FIG. 3 is an equivalent circuit diagram of a pixel of an LCD according to an embodiment of the present invention.

FIG. 1 is a block diagram of an LCD according to an embodiment of the present invention, FIG. 2 is an exploded perspective view of an LCD according to an embodiment of the present invention, and FIG. 3 is an equivalent circuit diagram of a pixel of an LCD according to an embodiment of the present invention.

Referring to FIG. 1, an LCD according to an embodiment of the present invention includes a LC panel assembly 300, a gate driver 400 and a data driver 500 which are connected to the panel assembly 300, a gray voltage generator 800 connected to the data driver 500, a lighting unit 900 for illuminating the panel assembly 300, and a signal controller 600 controlling the above elements.

In structural view, the LCD according to an embodiment of the present invention includes a display unit 330 and a backlight unit 340 as shown in FIG. 2.

The display unit 330 includes the LC panel assembly 300, a plurality of gate flexible printed circuit (FPC) films 410 and a plurality of data FPC films 510 attached to the LC panel assembly 300, and a gate printed circuit board (PCB) 450 and a data PCB 550 attached to the associated FPC films 410 and 510, respectively.

The LC panel assembly 300, in structural view shown in FIGS. 2 and 3, includes a lower panel 100, an upper panel 200 and a liquid crystal layer 3 interposed therebetween while it includes a plurality of display signal lines $G_1$–$G_n$ and $D_1$–$D_m$ and a plurality of pixels connected thereto and arranged substantially in a matrix in circuital view shown in FIGS. 1 and 3.

The display signal lines $G_1$–$G_n$ and $D_1$–$D_m$ are provided on the lower panel 100 and include a plurality of gate lines $G_1$–$G_n$ transmitting gate signals (called scanning signals) and a plurality of data lines $D_1$–$D_m$ transmitting data signals. The gate lines $G_1$–$G_n$ extend substantially in a row direction and are substantially parallel to each other, while the data lines $D_1$–$D_m$ extend substantially in a column direction and are substantially parallel to each other.

Each pixel includes a switching element Q connected to the display signal lines $G_1$–$G_n$ and $D_1$–$D_m$, and an LC capacitor $C_{LC}$ and a storage capacitor $C_{ST}$ that are connected to the switching element Q. The storage capacitor $C_{ST}$ may be omitted if unnecessary.

The switching element Q such as a TFT is provided on the lower panel 100 and has three terminals: a control terminal connected to one of the gate lines $G_1$–$G_n$; an input terminal connected to one of the data lines $D_1$–$D_m$; and an output terminal connected to the LC capacitor $C_{LC}$ and the storage capacitor $C_{ST}$.

The LC capacitor $C_{LC}$ includes a pixel electrode 190 on the lower panel 100, a common electrode 270 on the upper panel 200, and the LC layer 3 as a dielectric between the electrodes 190 and 270. The pixel electrode 190 is connected to the switching element Q, and the common electrode 270 covers the entire surface of the upper panel 100 and is supplied with a common voltage Vcom. Alternatively, both the pixel electrode 190 and the common electrode 270, which have shapes of bars or stripes, are provided on the lower panel 100.

The storage capacitor $C_{ST}$ is an auxiliary capacitor for the LC capacitor $C_{LC}$. The storage capacitor $C_{ST}$ includes the pixel electrode 190 and a separate signal line (not shown), which is provided on the lower panel 100, overlaps the pixel electrode 190 via an insulator, and is supplied with a predetermined voltage such as the common voltage Vcom. Alternatively, the storage capacitor $C_{ST}$ includes the pixel electrode 190 and an adjacent gate line called a previous gate line, which overlaps the pixel electrode 190 via an insulator.

For color display, either each pixel represents only one of three primary colors (spatial division) such that spatial average of the primary colors makes a desired color, or each pixel represents three primary colors in turn (time division) such that temporal average of the primary colors makes a desired color. FIG. 3 shows an example of spatial division by providing one of a plurality of red, green and blue color filters 230 in an area occupied by the pixel electrode 190. The color filter 230 shown in FIG. 3 is provided in the corresponding area of the upper panel 200. Alternatively, the color filter 230 is provided on or under the pixel electrode 190 on the lower panel 100.

Referring to FIG. 2, the backlight unit 340 includes a plurality of lamps 341 disposed at edges of the LC panel assembly 300, a plurality of lamp covers 345 for protecting the lamps 341, a light guide 342 and a plurality of optical sheets 343 disposed between the panel assembly 300 and the lamps 341 and guiding and diffusing light from the lamps 341 to the panel assembly 300, and a reflector 344 disposed under the lamps 341 and reflecting the light from the lamps 341 toward the panel assembly 300.

The lamps 341 preferably include fluorescent lamps such as CCFL (cold cathode fluorescent lamp) and EEFL (external electrode fluorescent lamp). An LED is another example of the lamp 341.

The lamps 341 shown in FIG. 2 are included in the lighting unit 900 shown in FIG. 1.

A pair of polarizers (not shown) polarizing the light from the lamps 341 are attached on the outer surfaces of the panels 100 and 200 of the panel assembly 300.

Referring to FIGS. 1 and 2, the gray voltage generator 800 generates two sets of a plurality of gray voltages related to the transmittance of the pixels and is provided on the data PCB 550. The gray voltages in one set have a positive polarity with respect to the common voltage Vcom, while those in the other set have a negative polarity with respect to the common voltage Vcom.

The gate driver 400 preferably includes a plurality of integrated circuit (IC) chips mounted on the respective gate FPC films 410. The gate driver 400 is connected to the gate lines $G_1$–$G_n$ of the panel assembly 300 and synthesizes the gate-on voltage Von and the gate off voltage Voff from the driving voltage generator 700 to generate gate signals for application to the gate lines $G_1$–$G_n$.

The data driver 500 preferably includes a plurality of IC chips mounted on the respective data FPC films 510. The data driver 500 is connected to the data lines $D_1$–$D_m$ of the panel assembly 300 and applies data voltages selected from the gray voltages supplied from the gray voltage generator 800 to the data lines $D_1$–$D_m$.

According to another embodiment of the present invention, the IC chips of the gate driver 400 and/or the data driver 500 are mounted on the lower panel 100, while one or both of the drivers 400 and 500 are incorporated along with other elements into the lower panel 100 according to still another embodiment. The gate PCB 450 and/or the gate FPC films 410 may be omitted in both cases.

The signal controller 600 controlling the drivers 400 and 500, etc. is provided on the data PCB 550 or the gate PCB 450.

Now, the operation of the LCD will be described in detail.

The signal controller 600 is supplied with RGB image signals R, G and B and input control signals controlling the display thereof such as a vertical synchronization signal Vsync, a horizontal synchronization signal Hsync, a main clock MCLK, and a data enable signal DE, from an external graphic controller (not shown). After generating gate control signals CONT1 and data control signals CONT2 and processing the image signals R, G and B suitable for the operation of the panel assembly 300 on the basis of the input control signals and the input image signals R, G and B, the signal controller 600 provides the gate control signals CONT1 for the gate driver 400, and the processed image signals R', G' and B' and the data control signals CONT2 for the data driver 500.

The gate control signals CONT1 include a vertical synchronization start signal STV for informing of start of a frame, a gate clock signal CPV for controlling the output time of the gate-on voltage Von, and an output enable signal OE for defining the width of the gate-on voltage Von. The data control signals CONT2 include a horizontal synchronization start signal STH for informing of start of a horizontal period, a load signal LOAD or TP for instructing to apply the appropriate data voltages to the data lines $D_1$–$D_m$, an inversion control signal RVS for reversing the polarity of the data voltages (with respect to the common voltage Vcom) and a data clock signal HCLK.

The data driver 500 receives a packet of the image data R', G' and B' for a pixel row from the signal controller 600 and converts the image data R', G' and B' into the analogue data voltages selected from the gray voltages supplied from the gray voltage generator 800 in response to the data control signals CONT2 from the signal controller 600.

Responsive to the gate control signals CONT1 from the signals controller 600, the gate driver 400 applies the gate-on voltage Von to the gate line $G_1$–$G_n$, thereby turning on the switching elements Q connected thereto.

The data driver 500 applies the data voltages to the corresponding data lines $D_1$–$D_m$ for a turn-on time of the switching elements Q (which is called "one horizontal period" or "1H" and equals to one periods of the horizontal synchronization signal Hsync, the data enable signal DE, and the gate clock signal CPV). Then, the data voltages in turn are supplied to the corresponding pixels via the turned-on switching elements Q.

The difference between the data voltage and the common voltage Vcom applied to a pixel is expressed as a charged voltage of the LC capacitor $C_{LC}$, i.e., a pixel voltage. The liquid crystal molecules have orientations depending on the magnitude of the pixel voltage and the orientations determine the polarization of light passing through the LC capacitor $C_{LC}$. The polarizers convert the light polarization into the light transmittance.

By repeating this procedure, all gate lines $G_1$–$G_n$ are sequentially supplied with the gate-on voltage Von during a frame, thereby applying the data voltages to all pixels. When the next frame starts after finishing one frame, the inversion control signal RVS applied to the data driver 500 is controlled such that the polarity of the data voltages is reversed (which is called "frame inversion"). The inversion control signal RVS may be also controlled such that the polarity of the data voltages flowing in a data line in one frame are reversed (which is called "line inversion"), or the polarity of the data voltages in one packet are reversed (which is called "dot inversion").

A lighting unit 900 will be described in detail with reference to FIGS. 4 and 5.

Figure 4:
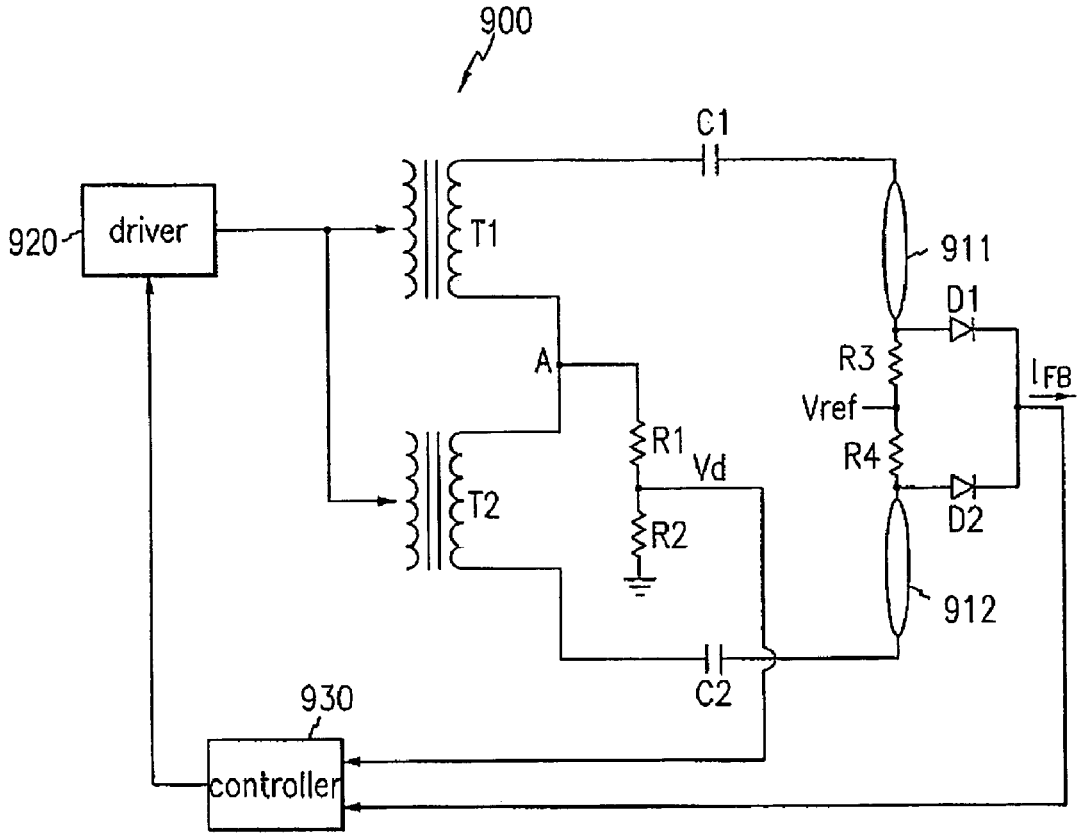
FIG. 4 is a schematic circuit diagram of an apparatus of driving light source for a liquid crystal display according to an embodiment of the present invention.
Figure 5:
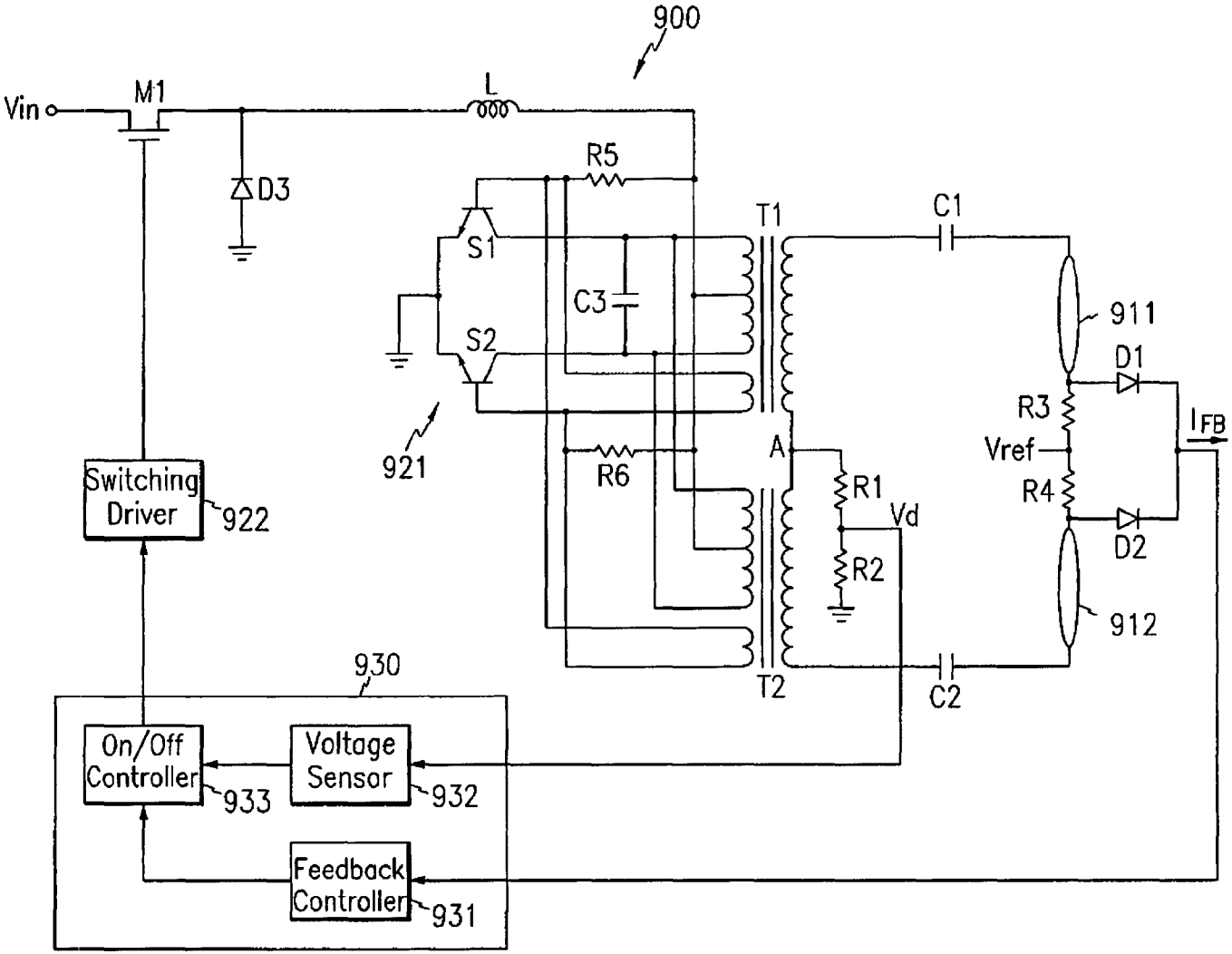
FIG. 5 is a circuit diagram of an apparatus of driving light source according to an embodiment of the present invention.

FIG. 4 is a schematic circuit diagram of a lighting unit for an LCD according to an embodiment of the present invention, and FIG. 5 is an exemplary detailed circuit diagram of a lighting unit according to an embodiment of the present invention.

As shown in FIG. 4, a lighting unit 900 according to an embodiment of the present invention includes a plurality of lamps 911 and 912 and an inverter for driving and controlling the lamps 911 and 912. The inverter includes a driver 920 for driving the lamp 911 and 912, a controller 930, a pair of transformers T1 and T2, a pair of ballast capacitors C1 and C2, a plurality of resistors R1, R2, R3 and R4, and a pair of diodes D1 and D2. The transformers T1 and T2 are connected between the driver 920 and the lamps 911 and 912, respectively, and a driving signal from the driver 920 is supplied to the lamps 911 and 912 through the transformers T1 and T2. The driver 920 is connected to primary coils of the transformers T1 and T2, and secondary coils of the transformers T1 and T2 are connected to first terminals of the lamps 911 and 912 through the capacitors C1 and C2 for stabilizing currents in the respective lamps 911 and 912.

Second terminals of the lamps 352*a* and 352*b* are commonly connected to a reference voltage Vref through the resistors R3 and R4, respectively, and the lamps 911 and 912 are lightened by the voltage difference between the reference voltage Vref and voltages supplied to the lamps 911 and 912. The reference voltage Vref is preferably a ground voltage. The total current $I_{FB}$ from the lamps 911 and 912 passing through the diodes D1 and D2 is supplied to the controller 930 as a feedback current. The secondary coils of the transformers T1 and T2 are connected to each other, and a node A between the transformers T1 and T2 works as a neutral point in that a load formed by the capacitor C1 and the lamp 911 and a load formed by the capacitor C2 and the lamp 912 are symmetrical. The node A is connected to a voltage divider for dividing a voltage thereof, which includes the resistors R1 and R2 connected in series between the node A and a ground. The controller 930 senses a voltage Vd between the resistors R1 and R2 and shuts down the lighting unit 900 by supplying an off signal to the driver 920 if the voltage Vd becomes to have a reference value.

In detail, the voltage at the node A is relatively small during a normal operation since the lamps 911 and 912 symmetrically operate. However, when the load of one of the lamps 911 and 912 becomes larger than the other due to an abnormal operation such as arc generation caused by disconnection of the transformers T1 and T2, the neutral point the transformer T1 and T2 is moved and such that the voltage Vd at the node A has a value much larger than the reference value. Then, the controller 930 shuts down the driver 920.

A lighting unit according to an embodiment of the present invention will be described in more detail with reference to FIG. 5, which illustrates an exemplary circuit of a lighting unit.

Referring to FIG. 5, the driver 920 includes a MOSFET M1, a diode D3, an inductor L, a Royer circuit 921 and a switching driver 922, and the controller includes a feedback controller 931, a voltage sensor 932 and an on/off controller 933.

The MOSFET M1 transmits a DC input voltage Vin to the Royer circuit 921 via the inductor L in response to a switching signal of the switching driver 922. The transformers T1 and T2 are connected in parallel to the inductor L.

The Royer circuit 921 includes a pair of transistors S1 and S2, a pair of resistors R5 and R6, and a capacitor C3. The transistors S1 and S2 have respective emitters connected to a ground, bases connected to the inductor L via the resistors R5 and R6, respectively, and collectors connected by the capacitor C3. The transformers T1 and T2 are connected in parallel to the collectors and to the bases of the transistors T1 and T2. The Royer circuit 921 converts a DC signal from the DC voltage Vin into an AC signal to be supplied to the lamps 911 and 912.

The lamps 911 and 912 are discharged by output voltages of the secondary coils of the transformers T1 and T2, and the currents passing through the lamps 911 and 912 join to become the feedback-current $I_{FB}$ to be supplied to the feedback controller 931. The feedback controller 931 supplies a signal to the on/off controller 933 for controlling the driver 920 based on the feedback current $I_{FB}$. The voltage sensor 932 measures a voltage, which is divided by the resistors R1 and R2 from the voltage between the node A and the ground, and makes the on/off controller 933 generate an off signal when the measured voltage has a value larger than the reference level. The switching driver 922 turns off the MOSFET M1 to shut down the inverter 900 in response to the off signal.

According to another embodiment of the present invention, a plurality of lamps connected in series are connected to each transformer T1 and T2. According to another embodiment of the present invention, the transformers T1 and T2 are driven by respective drivers.

While the present invention has been described in detail with reference to the preferred embodiments, it is to be understood that the invention is not limited to the disclosed embodiments, but, on the contrary, is intended to cover various modifications and equivalent arrangements included within the sprit and scope of the appended claims.

What is claimed is:

1. An apparatus of driving a liquid crystal display comprising:

first and second lamp units;

a first transformer including a primary side and a secondary side having a first terminal connected to the first lamp unit and a second terminal;

a second transformer including a primary side and a secondary side having a first terminal connected to the second terminal of the secondary side of the first transformer and a second terminal connected to the second lamp unit;

a driver converting a DC signal into an AC signal and supplying the AC signal to the primary sides of the first and the second transformers; and a voltage sensor for sensing a voltage at a middle point between the second terminal of the secondary side of the first transformer and the first terminal of the secondary side of the second transformer.

2. The apparatus of claim 1, wherein the driver is shut down when the voltage sensed by the voltage sensor is larger than a reference voltage.

3. The apparatus of claim 2, further comprising a voltage divider for dividing the voltage at the middle point and providing the divided voltage for the voltage sensor.

4. The apparatus of claim 3, wherein the voltage divider comprises first and second resistors serially connected to the middle point.

5. The apparatus of claim 2, further comprising an on/off controller supplying an off signal to the driver in response to the voltage sensed by the voltage sensor.

6. The apparatus of claim 5, further comprising a feedback controller detecting a current flowing through the first and the second lamp units and controlling the on/off controller based on the detected current.

7. The apparatus of claim 1, wherein each of the first and the second lamp units comprises a single lamp.

8. The apparatus of claim 1, wherein each of the first and the second lamp units comprises a plurality of lamps connected in series.

9. The apparatus of claim 1, further comprising first and second resistors connected to the first and the second lamp units, respectively, and commonly connected to a ground.

10. The apparatus of claim 1, wherein the primary sides of the first and the second transformers are connected in parallel to the driver.

11. A liquid crystal display comprising:

a lighting unit including first and second lamps, first and second transformers respectively connected to the first and the second lamps, including primary sides and secondary sides, and transmitting an AC signal for driving the first and the second lamps, and a driver supplying a signal to the primary sides of the first and the second transformers; and a liquid crystal panel assembly having a liquid crystal for displaying images by adjusting transmittance of light generated from the lighting unit, wherein the secondary sides of the first and the second transformers are connected to each other to form a neutral point, and the lighting unit further comprises a voltage sensor for sensing a voltage of the neutral point.

12. The liquid crystal display of claim 11, wherein the driver is shut down when the voltage sensed by the voltage sensor is larger than a reference voltage.

* * * * *